United States Patent [19]

Markovich

[11] 4,446,900

[45] May 8, 1984

[54] FIREARM CARRYING CASE

[75] Inventor: Mark J. Markovich, Iowa Falls, Iowa

[73] Assignee: Welsh Sporting Goods Corp., Iowa Falls, Iowa

[21] Appl. No.: 378,915

[22] Filed: May 17, 1982

[51] Int. Cl.[3] ..... B65D 81/04

[52] U.S. Cl. ..... 150/52 R; 206/317; 206/523; 224/911; 224/913

[58] Field of Search ..... 150/52 R, 52 B, 52 F, 150/52 H, 52 J; 206/317, 523, 524, 810; 224/911, 912, 913; 190/41 Z

[56] References Cited

U.S. PATENT DOCUMENTS

| | | | |
|---|---|---|---|
| 2,018,551 | 10/1935 | Freling | 190/41 Z X |
| 2,301,182 | 11/1942 | Kaser | 190/41 Z X |
| 2,444,511 | 7/1948 | Kaufmann | 190/41 Z X |
| 2,464,069 | 3/1949 | Benson | 150/52 F |
| 2,706,036 | 4/1955 | Neal | 206/523 X |
| 2,808,093 | 10/1957 | Gilman | 150/52 F |
| 3,138,306 | 6/1964 | Bare | 206/317 |
| 4,143,695 | 3/1979 | Hoehn | 150/52 R |
| 4,182,391 | 1/1980 | Kjose | 150/52 R X |
| 4,260,004 | 4/1981 | Domke | 150/52 J X |
| 4,306,601 | 12/1981 | Wallis et al. | 150/52 R |

FOREIGN PATENT DOCUMENTS

| | | | |
|---|---|---|---|
| 2712748 | 9/1978 | Fed. Rep. of Germany | 206/523 |
| 1310508 | 3/1973 | United Kingdom | 206/523 |

*Primary Examiner*—William Price
*Assistant Examiner*—Sue A. Weaver
*Attorney, Agent, or Firm*—Carl Schaukowitch

[57] ABSTRACT

YA firearm carrying case, as it appears closed, comprises an outer fabric shell encasing two aluminum support walls positioned in a substantially parallel relationship and spaced-apart by two convoluted, interlocking foam beddings. The outer shell includes a three-sided zipper gusset and one-sided hinging gusset sewn along two side panels of the firearm carrying case. Opening the outer shell forms two identical half pieces, each defining a cavity within the firearm carrying case.

4 Claims, 13 Drawing Figures

FIREARM CARRYING CASE

BACKGROUND OF THE INVENTION

This invention relates to a new and improved carrying case intended for storage, protection and transportation of equipment or delicate items. More particularly, the invention relates to a new and improved firearm carrying case acceptable by the air carrier industry for transporting firearms on commercial airlines.

In the past, sleeve-like carrying cases fabricated from padded leather or padded canvas were used to protect the firearms from rugged handling by luggage handlers employed by the air carrier industry. On occasion, a person transporting the firearm would carelessly forget to unload the firearm prior to its delivery to a luggage handler. A recorded number of luggage handlers has been either killed or wounded when a loaded firearm in a sleeve-like carrying case had discharged during handling. As a result, the air carrier industry has prohibited the use of sleeve-like firearm carrying cases. Until now, the air carrier industry would only transport firearms if the firearms were stored in hard-shell firearm carrying cases constructed from plastic, metal or the like.

A typical hard-shell firearm carrying case has two metal or plastic shells attached on one side by two mechanical hinges for folding the firearm carrying case opened or closed and releasably attached on the opposite side by two mechanical latches for securing the firearm carrying case closed. Each shell contains a convoluted foam bedding which interlocks with each other upon closing the firearm carrying case. One or two handles are attached to the latching side to facilitate carrying the firearm carrying case.

The major objectives achieved by the hard-shell design are to inhibit displacement of a firearm within a closed carrying case and to absorb impact if jostled or otherwise disturbed. The hard shell primarily absorbs any induced impact, thereby, reducing shock to the firearm which may cause it to discharge, if loaded. The foam beddings nestle the firearm between the interlocking convoluted surfaces to inhibit the firearm from moving within the closed carrying case. Significant movement of the firearm within the carrying case may result in a collision between the firearm and the hard shell or another firearm encased therewith. A collision may cause damage to the firearm and possibly induce a sufficient shock to the firearm to discharge it, if loaded. Also, if the firearm moves within the carrying case, the trigger might drag against the interlocking convoluted surfaces of the foam beddings, thus, pulling the trigger to discharge a loaded firearm.

The effectiveness of the a hard-shell firearm carrying case was demonstrated during experimentation. Prior to its encasement, a chalk line outlining a shot gun was drawn on the convoluted surface of one foam bedding to mark its original position within the hard-shell carrying case. After the carrying case was dropped onto concrete pavement from a height of twenty feet (20'), the carrying case was opened and inspected. The result was that the shot gun had been significantly displaced from its original position inside the carrying case. Repeated drop-testing of the hard-shell case on its various sides and corners reflected the same results. Furthermore, at the conclusion of the experimentation, the hard-shell carrying case was cracked, splintered and perforated with holes exposing the foam beddings.

It is from these considerations and others that the present invention evolved. After presentation of the present invention to several major airlines through the passenger services department, these airlines overcame their initial skepticism and deemed this invention safe, reliable and acceptable for use on commercial air carriers.

SUMMARY OF THE INVENTION

The present invention provides significant improvements and advantages over prior art firearm carrying cases, particularly with respect to the inherent characteristics of absorbing impact and inhibiting displacement of a firearm from its original position within the firearm carrying case if jostled or otherwise disturbed. Generally summarized, the new and improved firearm carrying case, as it appears closed, comprises an outer shell encasing two aluminum support walls positioned in a substantially parallel relationship and spaced-apart by two convoluted, interlocking foam beddings. The outer shell, constructed from fabric material cut into particular dimensions and sewn together to form the desired, box-like configuration, includes a three-sided zipper gusset and a one-sided hinging gusset sewn between two side panels of the firearm carrying case. A zipper sewn to the three-sided zipper gusset and the hinging gusset are arranged so that when the carrying case is opened the two opposite halves of the outer shell form identical half pieces, each defining a cavity within the firearm carrying case. The hinging gusset is fabricated by enveloping a sheet of REBOUND, a fiberous base material, with the fabric material comprising the outer shell, folding the enveloped REBOUND along its longitudinal centerline and sewing a seam within a half-inch (½") therefrom to facilitate a consistent alignment of the two convoluted foam beddings upon closing the firearm carrying case. Each of the aluminum support walls comprises a substantially flat wall extending similarly as the side panel and two flanges extending transversely along the outer longitudinal edges of the flat wall to define a U-shaped channel. Each of the aluminum support walls are received by each cavity wherein each of the aluminum support walls provides rigid support to each side panel of the outer shell. A thin sponge padding separates each aluminum support wall from each side panel for outer appearance purposes. Each of the convoluted foam beddings is received by each cavity to occupy the remaining space therein. A flat side of each foam bedding is glued to the flat wall of the aluminum support wall within the U-shaped channel. Fingers and recesses constitute the convoluted side of each of the foam beddings. Upon folding the two half shells closed, the fingers extending outwardly from each cavity and the recesses sinking inwardly into each cavity interlock around a firearm and the fingers provide a compression force to each side of the firearm to secure it firmly in place, thereby, inhibiting its displacement therein if jostled or otherwise disturbed. Any force applied to collapse the side panels together enhances the compression force on each side of the firearm which, in turn, creates a greater resistivity of the firearm to displace within a closed firearm carrying case. Any impact induced to the support walls of the firearm carrying case is absorbed and dissipated through the interaction of the aluminum support walls with the foam beddings. Both side panels have two end portions of a nylon web strap sewn on each side of lateral centerline of each of the side panels to form handles for carrying the firearm carrying case.

The present invention is described and shown in greater specificity in the following detailed description of the invention in drawings. Comprehension of the various aspects of the invention should lead to an increased appreciation for the significance of the invention and its advancement over the prior art.

BRIEF DESCRIPTION OF THE DRAWINGS

Other objects, advantages and capabilities of the present invention will become more apparent as the description proceeds, taken in conjunction with the accompanying drawings, in which.

DESCRIPTION OF PREFERRED EMBODIMENT

Figure 1:
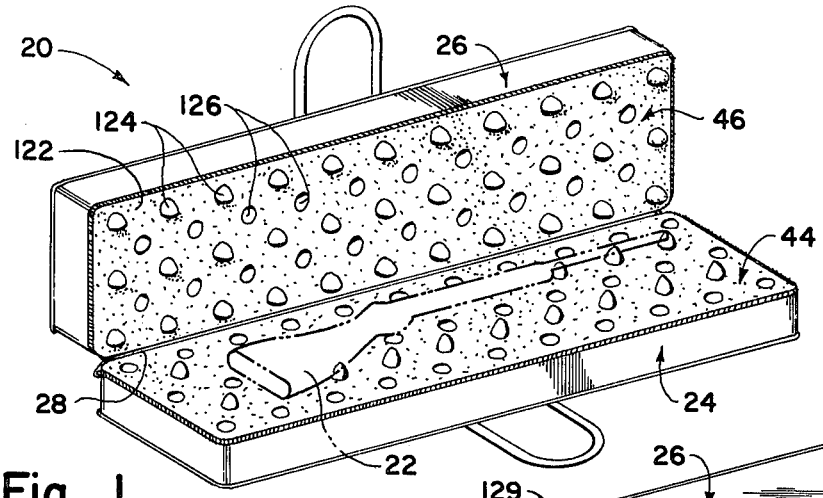
FIG. 1 is a perspective view of the firearm carrying case shown substantially opened and having a phantomly drawn rifle positioned therein.
Figure 2:
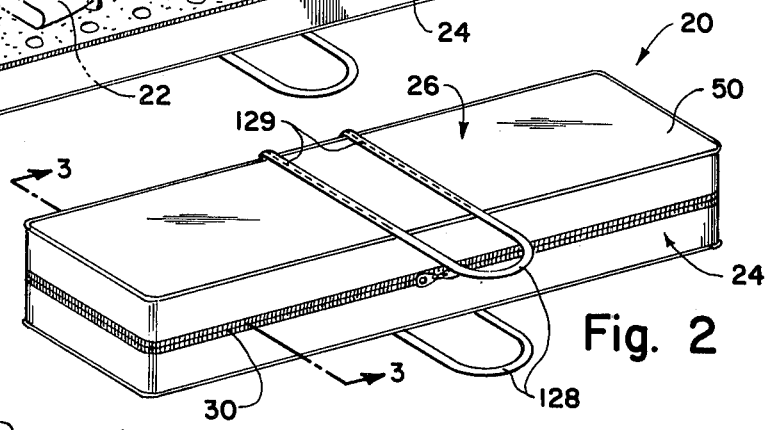
FIG. 2 is a perspective view of the firearm carrying case in FIG. 1 shown completely zippered closed.
Figure 3:
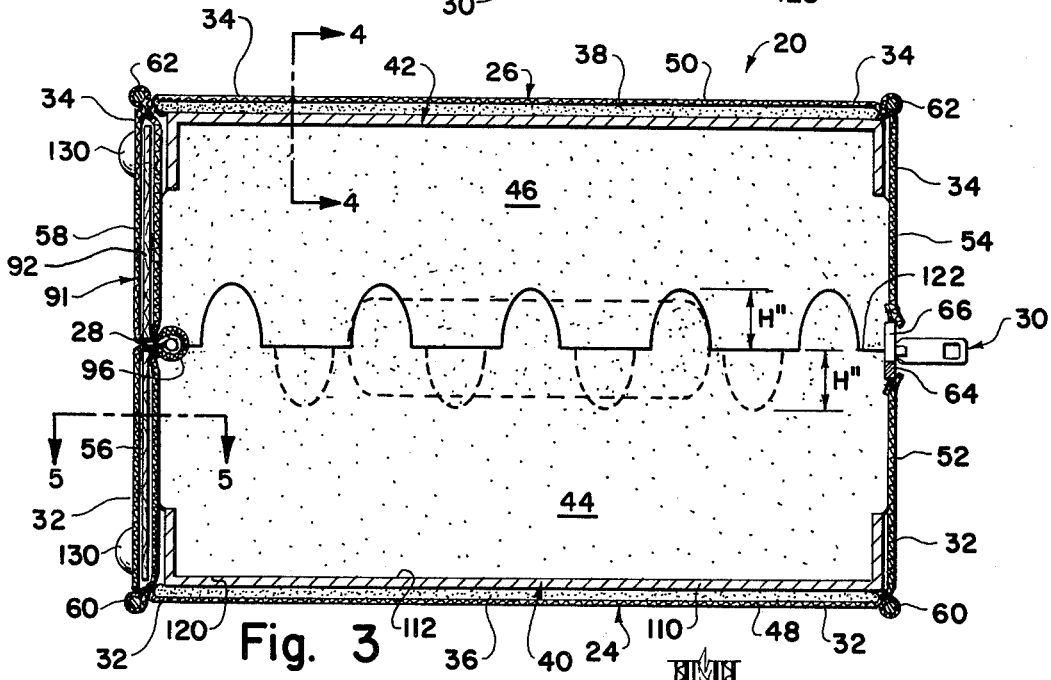
FIG. 3 is a transverse cross-sectional view of the firearm carrying case having the handles removed and taken substantially in the plane of line 3—3 of FIG. 2, illustrating the components and composition of the firearm carrying case.

A firearm carrying case 20 of the present invention is generally introduced by FIGS. 1, 2 and 3. As shown in FIG. 1, a rifle 22, phantomly drawn, lies on a first half-shell assembly 24 of the firearm carrying case 20. A second half-shell assembly 26 is pivoted away from the first half-shell assembly 24 along a sewn seam 28 to depict the firearm carrying case 20 in a substantially opened configuration. As shown in FIG. 2, the first half-shell assembly 24 and the second half-shell assembly 26 of the firearm carrying case 20 are securely attached to each other by a standard zipper 30 to depict the firearm carrying case 20 in a closed configuration. The half-shell assembly 24 and the half-shell assembly 26 hingably attached in a mirror relationship are fabricated identically for the purpose of efficient manufacturing although dimensional changes could be made and not result as a departure from the spirit of this invention. As shown in FIG. 3, the first half-shell assembly 24 and the second half-shell assembly 26 comprise respectively a first soft-shell subassembly 32 and a corresponding second soft-shell subassembly 34 encasing respectively a first sponge padding 36 and a corresponding second sponge padding 38, a first rigid support wall 40 and a corresponding second rigid support wall 42 and first convoluted foam bedding 44 and a corresponding second convoluted foam bedding 46.

Because the first half-shell assembly 24 and the second half-shell assembly 26 have been fabricated identically for the preferred embodiment of the present invention, only the first half-shell assembly 24 will be described for simplicity of reading and reference to "first" or "second" insofar as it applies to the description of the half-shell assemblies 24 and 26 will be deleted. Any corresponding second component will be numbered in parenthesis throughout the description of the preferred embodiment. Where clarity is required or convenient reference to the figures dictates, these parenthetical numbers will appear in the figures.

As best shown in FIG. 3, the soft-shell subassembly 32 (or 34) of the half-shell assembly 24 (or 26) comprises an outer side panel 48 (or 50), a three-sided fastening half-gusset 52 (or 54), a one-sided hinging half-gusset 56 (or 58), a welting 60 (or 62) and a zipper track 64 (or 66) of the zipper 30. The soft-shell subassembly 32 (or 34) is primarily constructed from CORDURA nylon. CORDURA is a registered trademark of I. E. DuPont, Inc. for a high-strength, durable, lightweight, water resistant nylon and is typically used for soft-sided luggage by the luggage industry.

Figure 8:
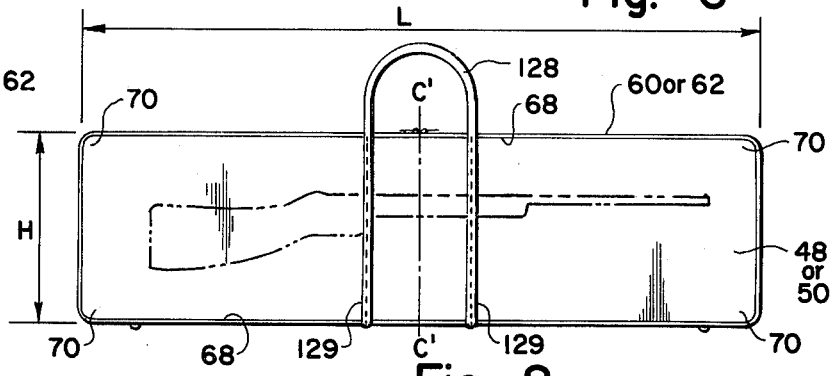
FIG. 8 is a front elevational view of the firearm carrying case shown in FIG. 1 illustrating a phantomly-drawn rifle positioned therein.

As shown in FIG. 8, the outer side panel 48 (or 50), is cut along its peripheral edge 68 into a substantially rectangular configuration having rounded corners 70 to define a length L and a height H of the firearm carrying case.

Figure 6:
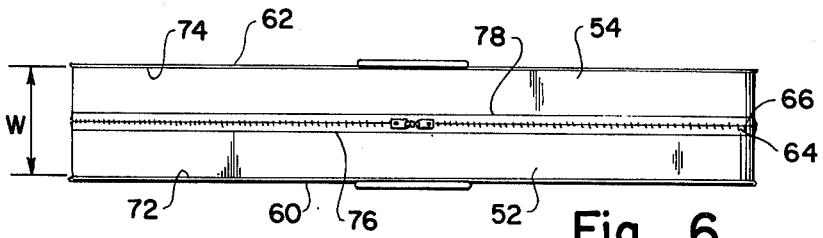
FIG. 6 is a top planar view of the firearm carrying case shown in FIG. 1.
Figure 7:
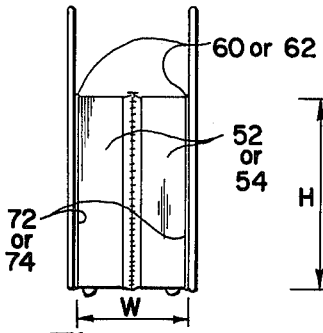
FIG. 7 is a side elevational view of the firearm carrying case shown in FIG. 1.
Figure 9:
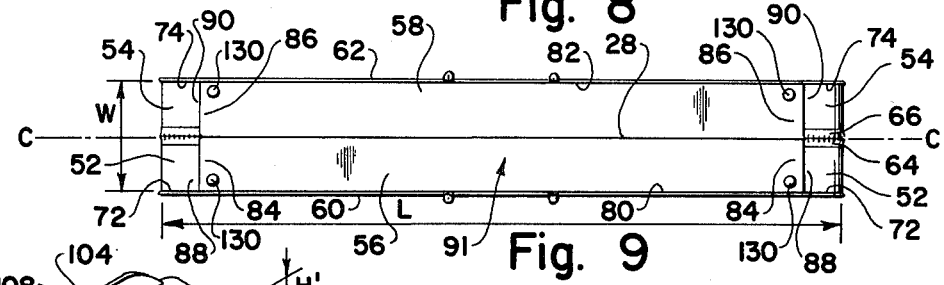
FIG. 9 is a botton planar view of the firearm carrying case shown in FIG. 1.

It is worthy to note that the word "gusset" is a common term known throughout the luggage industry. As applied to the present invention, a gusset is that portion of the firearm carrying case that extends between the side panels 48 and 50 and transversely from and circumventially along each peripheral edge 68 of the outer side panels 48 and 50 to define a width W of the firearm carrying case, as shown in FIGS. 6, 7 and 9. The gusset provides foundational support for hinging and latching the half-shell assemblies 24 and 26 together so that the firearm carrying case can be folded opened and latched closed. The present invention would be considered throughout the luggage industry as a carrying case with a three-sided zipper gusset.

The peripheral edge 68 of the outer side panel 48 (or 50) is sewn to the welting 60 (or 62), as best shown in FIG. 8. The welting 60 (or 62), typically found on soft-sided luggage, is a flexible cord wrapped with CORDURA nylon. The purposes of the welting 60 (or 62) are to insure seam strength, provide additional shaping and enhance the overall appearance of the firearm carrying case.

As shown in FIGS. 6, 7 and 9, a first longitudinal edge 72 (or 74) of the fastening half-gusset 52 (or 54) is sewn transversely to the peripheral edge 68 (FIG. 8) of the outer side panel 48 (or 50), but separated by and also sewn to the welting 60 (or 62). The fastening half-gusset 52 (or 54) extends about all four rounded corners 70 of the outer side panel 48 (or 50) and terminates shortly after rounding two of the four rounded corners 70, as best shown in FIG. 9. The zipper track 64 (or 66) is sewn along a second longitudinal edge 76 (or 78) of the fastening half-gusset 52 (or 54) as shown in FIG. 6.

As shown in FIG. 9, the hinging half-gusset 56 (or 58) completes the half-gusset portion of the firearm carrying case. A longitudinal edge 80 (or 82) of the hinging half-gusset 56 (or 58) is sewn transversely to both the welting 60 (or 62) and the remaining portion of the peripheral edge 68 of the outer side panel 48 (or 50). Lateral edges 84 (or 86) of the hinging half-gusset 56 (or 58) are sewn to lateral edges 88 (or 90) of the fastening half-gusset 52 (or 54).

Figure 5:
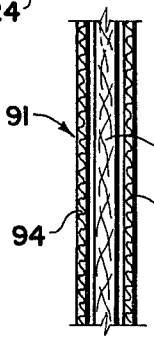
FIG. 5 is an enlarged cross-sectional view taken substantially in the plane of line 5—5 of FIG. 3, illustrating the components and composition of the hinging panel of the firearm carrying case.

The hinging half-gusset 56 and the hinging half-gusset 58 combine to form a unitary hinging panel 91, as shown in FIGS. 3 and 9. The hinging panel 91 is fabricated by enveloping a sheet of REBOUND 92 (FIG. 5) with CORDURA nylon 94, folding the enveloped REBOUND 92 along its longitudinal centerline C—C (FIG. 9) and sewing seam 28 (FIGS. 3 and 9) within a half-inch (½") therefrom to form a folded portion 96 (FIG. 3) of the hinging panel 91. The hinging panel 91 facilitates consistent alignment of the half-shell assemblies 24 and 26 upon closing the firearm carrying case. REBOUND 92 is a trademark of Lydall, Inc. for a unique backing material made of a fiberous base material saturated with a resilient elastomer. REBOUND 92 is commonly used in the soft-sided luggage industry as a collapsible gusset.

The outer side panel 48 (or 50), the fastening half-gusset 52 (or 54) and the hinging half-gusset 56 (or 58) assembled to form the soft-shell subassembly 32 (or 34) define an elongated, box-like cavity (not shown). The cavity receives and houses the sponge padding 36 (or 38), the support wall 40 (or 42) and the convoluted foam bedding 44 (or 46), as shown in FIG. 3.

Figure 4:
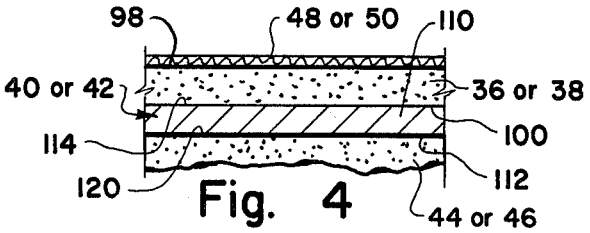
FIG. 4 is an enlarged cross-sectional view taken along lines 4—4 of FIG. 3, illustrating the components and composition of the firearm carrying case.

The sponge padding 36 (or 38) is a flat sheet of sponge or foam material having a thickness of less than one inch (1") and extends substantially similarly as the outer side panel 48 (or 50). As best shown in FIG. 4, a first flat side 98 of the sponge padding 36 (or 38) abuts the outer side panel 48 (or 50). A second flat side 100 of the sponge padding 36 (or 38) abuts the support wall 40 (or 42). The sponge padding 36 (or 38) is used primarily for outer appearance purposes.

The support wall 40 (or 42), as shown in FIGS. 3 and 4, is constructed from a sheet of aluminum having the following specifications:

1. Grade #5052-H32 with a Thickness of 0.050
2. Ultimate Tensil strength 33 lbs.
3. Yield Strength 28 lbs.
4. Modulus of elasticity 10.2 lbs.

Figure 11:
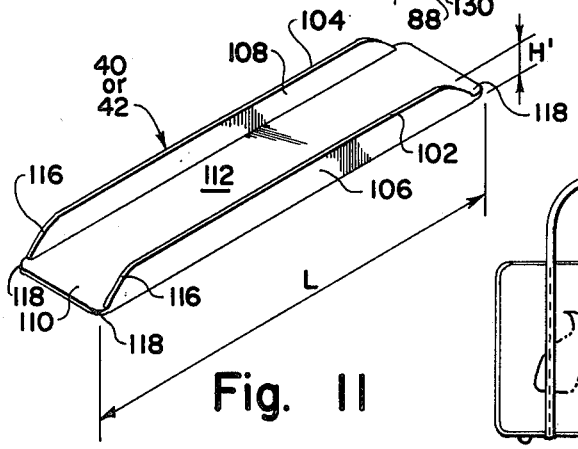
FIG. 11 is a perspective view of a rigid support wall defining a U-shaped channel, a component of the firearm carrying case, shown in FIG. 3.

The support wall 40 (or 42), as shown in FIG. 11, is cut from a sheet of aluminum having the length L. The aluminum sheet is bent approximately 90 degrees near its longitudinal edges 102 and 104, thereby, forming a first flange 106 and second flange 108 having a height H' of approximately one inch (1"). As best shown in FIGS. 4 and 11, a side wall member 110 of the support wall 40 (or 42) having an inner surface 112 and an outer surface 114, retains the flange members 106 and 108 in a substantially parallel relationship to define a "U-Shaped" channel. Ends 116 of both flange members 106 and 108 taper toward the inner surface 112 of the side wall member 110. Four corners 118 where the inner surface 112 of the side wall member 110 joins the tapering ends 116 of the flange members 106 and 108 are rounded to prevent excess wear on the soft-shell subassemblies 32 and 34 and the impailing of a luggage handler or bystander.

As shown in FIG. 3, the remainder of the cavity formed by the assembled soft-shell subassembly 32 (or 34) is completely occupied by the convoluted foam beddings 44 (or 46). As shown in FIGS. 3 and 4, a substantially flat first surface 120 of the convoluted foam bedding 44 (or 46) is received by the "U-Shaped" channel and is glued to the inner surface 112 of the side wall member 110. As shown in FIGS. 1 and 3, a second surface 122 of the convoluted foam bedding 44 (or 46) includes alternating rows of conically-shaped fingers 124 and conically-shaped recesses 126. As shown in FIG. 3, each of the fingers 124 have a height H" of approximately one and a half inches (1½") as measured from the second surface 122. The alternating rows of fingers 124 and recesses 126 are arranged such that, upon closing an empty firearm carrying case, the fingers 124 are received by and substantially align with the recesses 126 in a mating relationship.

As shown in FIGS. 2 and 8, strap-like nylon web handles 128, which are typically used in the soft-sided luggage industry, are sewn to the outer side panels 48 and 50. End portions 129 of each of the strap-like nylon web handles 128 are sewn equidistantly from and on each side of a lateral centerline C'—C' to each side panel 48 and 50 to facilitate carrying the firearm carrying case, as best shown in FIG. 8.

As shown in FIGS. 3 and 9, hemispherically-shaped, plastic shoes 130 are firmly secured to each of four corner areas of the hinging panel 91. These shoes 130 are typically spaced apart as shown in FIG. 9, and are commonly used on soft-sided luggage to suspend the fabric material above common resting places.

Figure 12:
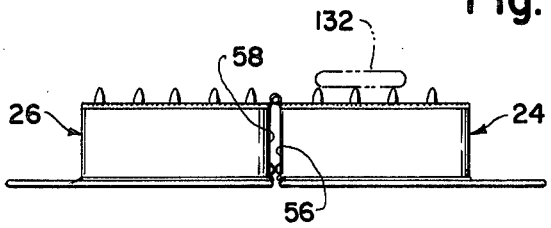
FIG. 12 is a side elevational view illustrating a completely opened firearm carrying case, shown in FIG. 1, having a phantomly-drawn rifle butt resting thereon.
Figure 13:
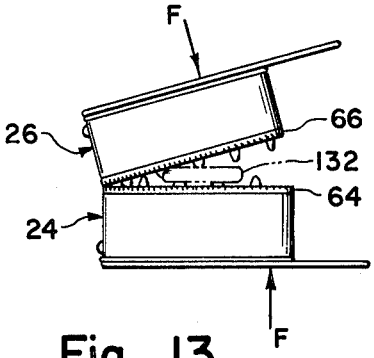
FIG. 13 is a side elevational view illustrating a partially opened firearm carrying case, shown in FIG. 1, having a phantomly-drawn rifle butt nestled therein.

The significant features and advantages of the assembled firearm carrying case are best illustrated in FIGS. 12 and 13. In FIG. 12, the firearm carrying case is fully opened and a phantomly-drawn rifle butt 132 of the rifle 22 lays upon the half-shell assembly 24. The hinging half-gussets 56 and 58 maintain a rigid, upright configuration longitudinally along the length L (FIG. 9) due to the unique and exceptional characteristics of REBOUND 92. Other backing material such as cardboard and plastic was used during experimentation in lieu of REBOUND. Because it was desirable to have a consistent folding of the hinging panel 91 to facilitate alignment of the fingers 124 with the casses 126, the seam 28, as shown in FIG. 9, was sewn along the longitudinal center line C—C. After continuous use, the other materials showed significant wear at seam 28 until the seam eventually failed. As a result of experimentation, it had been discovered REBOUND 92 exhibited the desired characteristics of being unaffected by the stitches while simultaneously providing a flexible, yet rigid, hinging panel 91.

Without such a desirable hinging panel 91, a person packing the firearm carrying case would probably need to adjust the half-shell assembly 24 onto the half-shell assembly 26 to properly align the fingers 124 over the recesses 126 before zipping the firearm carrying case closed. With a REBOUND hinging panel 91, the fingers 124 have a proclivity to align with the recesses 126 by merely folding the half-shell assembly 26 onto the half-shell assembly 24, as shown in FIG. 13.

As shown in FIG. 13, the rifle 22 depicted by the rifle butt 132 would prevent those fingers 124 which have come in contact with the rifle 22 from mating with the recesses 126. As a result, it is necessary to apply a force F to the half-shell assemblies 24 and 26 to bring the zipper tracts 64 and 66 in close proximity to each other so that the firearm carrying case can be easily zipped closed. Thus, the rifle 22 is securely retained in position inside the firearm carrying case by virtue of the fingers 124 applying a compression force on each side of the rifle 22.

Other significant advantages of the present invention are better comprehended by various experiments that had been conducted with a closed firearm carrying case containing a shot gun loaded with a blank shell. Prior to its encasement, a chalk line outlining the shot gun was drawn on the convoluted surface of one foam bedding to mark its original position within the present invention. After this firearm carrying case was dropped onto concrete pavement from a height of twenty feet (20'), the carrying case was opened and inspected. The shot gun did not discharge. Also, the displacement of the shot gun within the carrying case was minimal, particularly compared to the displacement of the shot gun which occurred in the drop-testing experiment for the hard-shell firearm carrying case. Repeated drop-testing reflected the same results except when the carrying case was dropped in a manner such that the support walls were unable to collapse together. In these instances, the shot gun displaced within the carrying case similar to the displacement of the shot gun during the drop-testing experiment with the hard-shell carrying case. Upon completion of the experimentation, scuffing of the half-shell assemblies was the only damage incurred by the present invention.

These experiments demonstrate the extraordinary characteristics of the present invention to absorb impact and inhibit displacement of a firearm from its original position therein, if jostled or otherwise distrubed. It is theorized that the support walls, the foam beddings, and their interaction with each other provide these extraordinary characteristics. Because aluminum cannot crack or splinter, the support walls more readily distribute impact induced to the side panels than plastic. Further, such impact is usually directed in a manner to cause the support walls to collapse together. If the support walls collapse together, the foam beddings between the support walls must also collapse, thereby, providing impact absorption for additional impact dissipation. A reduction of impact results in dissipated shock to the firearm encased within the present invention. Additionally, if a force is applied to collapse the side panels of the present invention, the compression force to the sides of the firearm encased therein increases, thereby, enhancing the resistivity of the firearm to displace.

Figure 10:
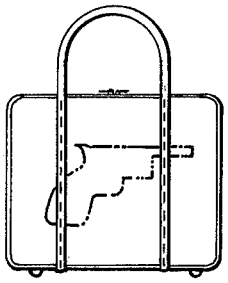
FIG. 10 is a front elevational view of an alternative embodiment of the firearm carrying case, shown in FIG. 1, illustrating a phantomly-drawn pistol positioned therein.

An alternate embodiment of the present invention, as shown in FIG. 10, encases a hand-held firearm. Dimensional changes to the length L, height H, and width W (not shown) of the alternative embodiment does not result as a departure from the spirit of this invention.

The preferred embodiment of the present invention and its significant advantages and advancements over prior art have been described with a degree of specificity. It should be understood, however, that the specificity of description has been made by way of example only and that the scope of the invention falls within the scope of the appended claims.

I claim:

1. A firearm carrying case, comprising:

two fabric shell assemblies, each including a fabric side panel member extending longitudinally and laterally and having a peripheral edge with four rounded corners and a fabric three-sided zipper half-gusset having a longitudinal edge and two terminal edges, said peripheral edge having a first portion defined by commencing at a first point on said peripheral edge where a first rounded corner begins or shortly therebefore and continuing around all of said four rounded corners to a second point where a fourth rounded corner terminates or shortly thereafter and a second portion defined by commencing at said first point on said peripheral edge extending longitudinally therealong and terminating at said second point on said peripheral edge, said three-sided zipper half-gusset being sewn transversely to said first portion of said peripheral edge of said side panel member along said longitudinal edge;

a hinging panel defined by two longitudinal edges and two lateral edges and including a backing material panel enveloped by a fabric material, folded at a longitudinal centerline, sewn within one-half inch (½") from said centerline to define a seam, each of said longitudinal edges sewn to each of said second portions of said peripheral edges of said panel members and each of said lateral edges sewn to each of said terminal edges of said three-sided zipper half-gusset and, upon folding said two fabric shell assemblies apart in an open configuration, defining a cavity within each of said fabric shell assemblies, said cavity having an inner portion and an outer portion;

two rigid support assemblies, each including a rigid wall member extending longitudinally and laterally and two rigid flange members extending longitudinally along and transversely from said rigid wall member to define a U-shaped channel, each of said two rigid support assemblies being received by each of said inner portions of said cavities in a substantially parallel relationship with each of said side panel members; and two foam beddings, each occupying each of said outer portions of said cavities and being received by each of said U-shaped channels and each substantially contacting each of said rigid wall members at a substantially flat first surface and each having a convoluted second surface defined by fingers and recesses, said fingers extending outwardly from said cavity and said recesses extending inwardly into said cavity, whereby upon folding said two fabric shell assemblies to a closed configuration, said convoluted surfaces of said foam beddings having a proclivity to align for interlocking said fingers with said recesses in a mating relationship.

2. A firearm carrying case as defined in claim 1, further comprising:

at least one handle attached to at least one of said side panel members.

3. A firearm carrying case as defined in claim 2, wherein:

said substantially flat surface of each of said foam beddings is glued within each of said U-shaped channels and to each of said rigid wall members.

4. A firearm carrying case as defined in claim 3, wherein:

said backing material is a fiberous base material saturated with a resilient elastomer.

* * * * *